US012729933B2

(12) United States Patent
Michel et al.

(10) Patent No.: US 12,729,933 B2
(45) Date of Patent: Sep. 8, 2026

(54) GUN SIGHT

(71) Applicant: mb-microtec ag, Niederwangen (CH)

(72) Inventors: Philipp Michel, Zollikofen (CH); Remo Pfaff, Urtenen-Schoenbuehl (CH)

(73) Assignee: mb-microtec ag, Niederwangen (CH)

( * ) Notice: Subject to any disclaimer, the term of this patent is extended or adjusted under 35 U.S.C. 154(b) by 0 days.

(21) Appl. No.: 19/038,082

(22) Filed: Jan. 27, 2025

(65) Prior Publication Data

US 2025/0251219 A1 Aug. 7, 2025

Related U.S. Application Data

(60) Provisional application No. 63/550,787, filed on Feb. 7, 2024.

(51) Int. Cl.
*F41G 1/34* (2006.01)

(52) U.S. Cl.
CPC ..... *F41G 1/34* (2013.01)

(58) Field of Classification Search
CPC ..... F41G 1/32; F41G 1/34; F41G 1/345
See application file for complete search history.

(56) References Cited

U.S. PATENT DOCUMENTS

| | | | | |
|---|---|---|---|---|
| 5,404,667 | A * | 4/1995 | Schmitter | F41G 1/02 42/111 |
| 5,930,906 | A * | 8/1999 | Howe | F41G 1/32 42/144 |
| 5,956,854 | A | 9/1999 | Lorocco | |
| 10,386,158 | B2 | 8/2019 | Kind et al. | |
| 10,415,930 | B2 | 9/2019 | Erdle | |
| 11,340,041 | B2 | 5/2022 | Salamon, III et al. | |
| 11,764,053 | B1 * | 9/2023 | Richter | H01J 65/00 313/54 |
| 2007/0107292 | A1 * | 5/2007 | Bar-Yona | F41G 1/30 42/144 |
| 2014/0109460 | A1 * | 4/2014 | Howe | F41G 1/08 42/132 |
| 2018/0010886 | A1 * | 1/2018 | Kind | H01J 61/35 |
| 2019/0351173 | A1 * | 11/2019 | Dantanarayana | A61M 16/0875 |
| 2023/0228523 | A1 * | 7/2023 | Smith | F41G 1/35 42/132 |
| 2023/0296352 | A1 | 9/2023 | Eaton et al. | |
| 2024/0102772 | A1 * | 3/2024 | Neff | F41G 1/345 |
| 2024/0128073 | A1 * | 4/2024 | Richter | F41G 1/345 |

FOREIGN PATENT DOCUMENTS

| | | | |
|---|---|---|---|
| CN | 216898554 | U | 7/2022 |
| EP | 2 161 532 | A2 | 3/2010 |
| WO | 2019209535 | A1 | 10/2019 |

* cited by examiner

*Primary Examiner* — Joshua E Freeman
(74) *Attorney, Agent, or Firm* — Sterne, Kessler, Goldstein & Fox P.L.L.C.

(57) ABSTRACT

Systems for providing an illuminated insert for a gun sight include an insert that is inserted into a gun sight. The insert can have an illuminator that provides a source of illumination to improve visual acquisition of the sight. The insert is secured in an opening in the sight by a locking feature that contacts portions of an interior of the sight to secure the insert into the sight. The insert can be secured solely by the mechanical interactions of the locking feature without any further techniques, such as adhesives or the like. The insert is not removable from the sight without the use of destructive techniques to ensure security of the insert.

34 Claims, 10 Drawing Sheets

GUN SIGHT

CROSS-REFERENCE TO RELATED APPLICATIONS

The present application claims the benefit of U.S. Provisional Application No. 63/550,787, filed on Feb. 7, 2024, which is incorporated herein by reference in its entirety.

BACKGROUND

This disclosure relates to the field of gun sights. Specifically, this disclosure is related to unpowered, self-illuminating gun sights for firearms.

Firearms are generally equipped with a sight mechanism to allow a user to aim the firearm. A category of such sights involves at least two sights fixed to and extending from the firearm. One sight is positioned closer to the open end of the barrel (away from the user), while the other sight is positioned closer to the user (closer to the opposite end of the firearm from the end of the barrel). The user aligns these sights visually to aim the firearm at a target. These types of sights are generally unpowered and usually have no optical elements, such as lenses or mirrors.

To improve visibility of these sights for the user, these types of sights often include markings or inserts that are in a contrasting color. In some instances, the markings or inserts are self-illuminating. This improves usability of the sights in reduced light conditions (e.g., at night) because the sights are not powered and cannot otherwise be illuminated. The inserts used in these sights must be securely fixed into the gun sight to ensure reliable operation of the sight by the user.

However, the inserts and the sights are generally small elements that require precise alignment during manufacturing and assembly. Further, the inserts are often fixed into the sights using an adhesive, which must be applied precisely to ensure the insert is properly fixed in the sight. These issues cause an increase in assembly time required, which in turn increases manufacturing costs.

Therefore, there is a need for systems and methods for fixing inserts in gun sights that results in a reliable connection between the insert and the sight while reducing manufacturing time and cost.

BRIEF SUMMARY

In an embodiment, an insert for a gun sight includes an insert body configured to be inserted into an opening in the gun sight and a locking feature fixed to an end of the insert body, the locking feature configured to secure the insert body in the gun sight.

In a further embodiment, the locking feature is fixed to the end of the insert body that is inserted into the gun sight.

In a further embodiment, a portion of the locking feature is configured to engage a portion of an interior of the gun sight to secure the insert body in the gun sight.

In a further embodiment, a portion of the locking feature is configured to move towards the insert body during insertion of the insert into the gun sight.

In a further embodiment, wherein the locking feature comprises a clearance portion configured to contact a portion of an interior of the gunsight to control an insertion depth of the insert into the gunsight by compensating any axial clearance between the locking feature of the insert and the engagement portion of the gun sight.

In a further embodiment, the locking feature can comprise a stem portion fixed to the end of the insert body. A first locking portion fixed to an end of the stem portion opposite the insert body, and the first locking portion can extend away from the insert body and configured to engage a portion of an interior of the gun sight to secure the insert body in the gun sight. A second locking portion can be fixed to the end of the stem opposite the insert body, such that the second locking portion can extend away from the insert body and configured to engage a second portion of the interior of the gun sight to secure the insert body in the gun sight. A clearance portion can be fixed to one of the first locking portion or the second locking portion. The clearance portion can be configured to contact a third portion of the interior of the gunsight to control an insertion depth of the insert into the gunsight by compensating any axial clearance between the locking feature of the insert and the engagement portion of the gun sight.

In a further embodiment, the insert body further comprising an illuminator recess located in the insert body and configured to receive an illuminator.

In a further embodiment, the illuminator recess is configured to retain the illuminator in the illuminator recess by contact between at least one illuminator retainer connected to the insert body and the illuminator.

In a further embodiment, the illuminator comprises gaseous tritium configured to produce illumination.

In a further embodiment, the illuminator comprises a hollow glass body that is coated with a phosphorescent material on the inner side of the hollow glass body In a further embodiment, the illuminator comprises a body formed from phosphorescent material In a further embodiment the illuminator comprises a light source and a power source operatively connected to the light source, the light source configured to use the power source to provide illumination.

In a further embodiment at least a part of the insert body comprises phosphorescent material.

In a further embodiment the illuminator recess is configured to receive the illuminator in a radial direction with respect to the insert body.

In a further embodiment the locking feature is configured to be destructively disabled by a tool inserted into the gun sight.

In a further embodiment the locking feature comprises a first stem portion fixed to the end of the insert body and a first locking portion fixed to an end of the first stem portion opposite the insert body, the first locking portion extending away from the insert body and configured to engage a portion of an interior of the gun sight to secure the insert body in the gun sight. The locking feature also comprises a second stem portion fixed to the end of the insert body and a second locking portion fixed to the end of the stem opposite the insert body, the second locking portion extending away from the insert body and configured to engage a second portion of the interior of the gun sight to secure the insert body in the gun sight. The locking feature also comprises a clearance portion fixed to one of the first locking portion or the second locking portion, the compensating portion configured to contact a third portion of the interior of the gunsight to control an insertion depth of the insert into the gunsight.

In an embodiment, an insert for a gun sight includes an insert body formed to be slidingly received into an opening in the gun sight. A locking feature can be fixed to an end of the insert body that is inserted into the opening in the gun sight. The locking feature can extend from the end of the insert body and having a locking portion configured to contact a portion of an interior of the gun sight to secure the insert body in the gun sight.

In a further embodiment the locking portion extends in a second direction perpendicular to a direction extending between the end of the insert body that is inserted into the opening and a second opposite end of the insert body. The locking portion can be formed to elastically deform towards the insert body during insertion of the insert into the gun sight.

In a further embodiment the locking feature can comprise a stem portion fixed to the end of the insert body and extending away from the insert body The locking portion can be fixed to an end of the stem portion opposite the insert body and extends from the stem portion. And a second locking portion can be fixed to the end of the stem portion opposite the insert body, such that the second locking portion extend away from the insert body and configured to engage a second portion of the interior of the gun sight to secure the insert body in the gun sight.

In a further embodiment the locking feature further comprises a clearance portion fixed to one of the first locking portion or the second locking portion. The clearance portion can be configured to extend away from the insert body and configured to contact a third portion of the interior of the gunsight to control an insertion depth of the insert into the gunsight.

In a further embodiment, the insert further comprises an illuminator recess located in the insert body and configured to receive an illuminator.

In a further embodiment the illuminator recess is configured to retain the illuminator in the illuminator recess by contact between at least one illuminator retainer of the insert body and the illuminator.

In a further embodiment the illuminator comprises gaseous tritium configured to produce illumination.

In a further embodiment the illuminator comprises a hollow glass body that is coated with a phosphorescent material on the inner side of the hollow glass body.

In a further embodiment the illuminator comprises a body formed from phosphorescent material.

In a further embodiment the illuminator comprises a light source and a power source operatively connected to the light source, the light source configured to use the power source to provide illumination.

In a further embodiment at least a part of the insert body comprises phosphorescent material.

In a further embodiment the illuminator recess is configured to receive the illuminator in a radial direction with respect to the insert body.

In a further embodiment the locking feature is configured to be destructively disabled by a tool inserted into the gun sight.

In a further embodiment the locking feature comprises a first stem portion fixed to the end of the insert body and a first locking portion fixed to an end of the first stem portion opposite the insert body, the first locking portion extending away from the insert body and configured to engage a portion of an interior of the gun sight to secure the insert body in the gun sight. The locking feature also comprises a second stem portion fixed to the end of the insert body and a second locking portion fixed to the end of the stem opposite the insert body, the second locking portion extending away from the insert body and configured to engage a second portion of the interior of the gun sight to secure the insert body in the gun sight. The locking feature also comprises a clearance portion fixed to one of the first locking portion or the second locking portion, the compensating portion configured to contact a third portion of the interior of the gunsight to control an insertion depth of the insert into the gunsight.

In an embodiment, a method of manufacturing an insert for a gun sight, comprises forming an insert body; and forming a locking feature fixed to an end of the insert body and extending away from the end of the insert body. The locking feature can be configured to secure the insert body in the gun sight.

In a further embodiment forming the locking feature can comprise forming a stem portion fixed to the end of the insert body and forming a first locking portion fixed to an end of the stem portion opposite the insert body. The first locking portion extends away from the insert body and is configured to engage a portion of an interior of the gun sight to secure the insert body in the gun sight. Forming the locking feature can also comprise forming a second locking portion fixed to the end of the stem opposite the insert body, the second locking portion extending away from the insert body and configured to engage a second portion of the interior of the gun sight to secure the insert body in the gun sight. Forming the locking feature can also comprise forming a clearance portion fixed to one of the first locking portion or the second locking portion, the clearance portion configured to contact a third portion of the interior of the gunsight to control an insertion depth of the insert into the gunsight.

In a further embodiment, the method further comprises forming an illuminator recess in the insert body that is configured to receive an illuminator, wherein the illuminator recess is configured to retain the illuminator in the illuminator recess by contact between at least one illuminator retainer of the insert body and the illuminator.

In a further embodiment, the method further comprises coating the illuminator with a coating configured to provide illumination in the absence of ambient light.

In an embodiment, a method of securing and removing an illuminator insert in a gun sight can comprise placing the insert having an insert body with a locking feature disposed at an end of the insert body into an opening in a gun sight. The insert body can comprise an illuminator recess to receive an illuminator. The method can also comprise allowing the locking feature to engage with a portion of an interior of the gun sight to secure the insert body into the gun sight. The method can also comprise disabling the locking feature by using a tool inserted through a second opening in the gun sight to enable removal of the illuminator.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

In the drawings, like reference numbers generally indicate identical or similar elements.

DETAILED DESCRIPTION

Reference will now be made in detail to representative embodiments illustrated in the accompanying drawings. References to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such a feature, structure, or characteristic in connection with other embodiments whether or not explicitly described.

Systems and methods of the present disclosure address the issue of assembly time and complexity while maintaining a reliable gun sight assembly. The inserts discussed below include a locking feature that secures the insert into the gun sight without requiring additional tools, adhesives, or precise positioning of the insert. This reduces assembly time, which decreases manufacturing costs. Other benefits of the present disclosure are discussed below.

Figure 1:
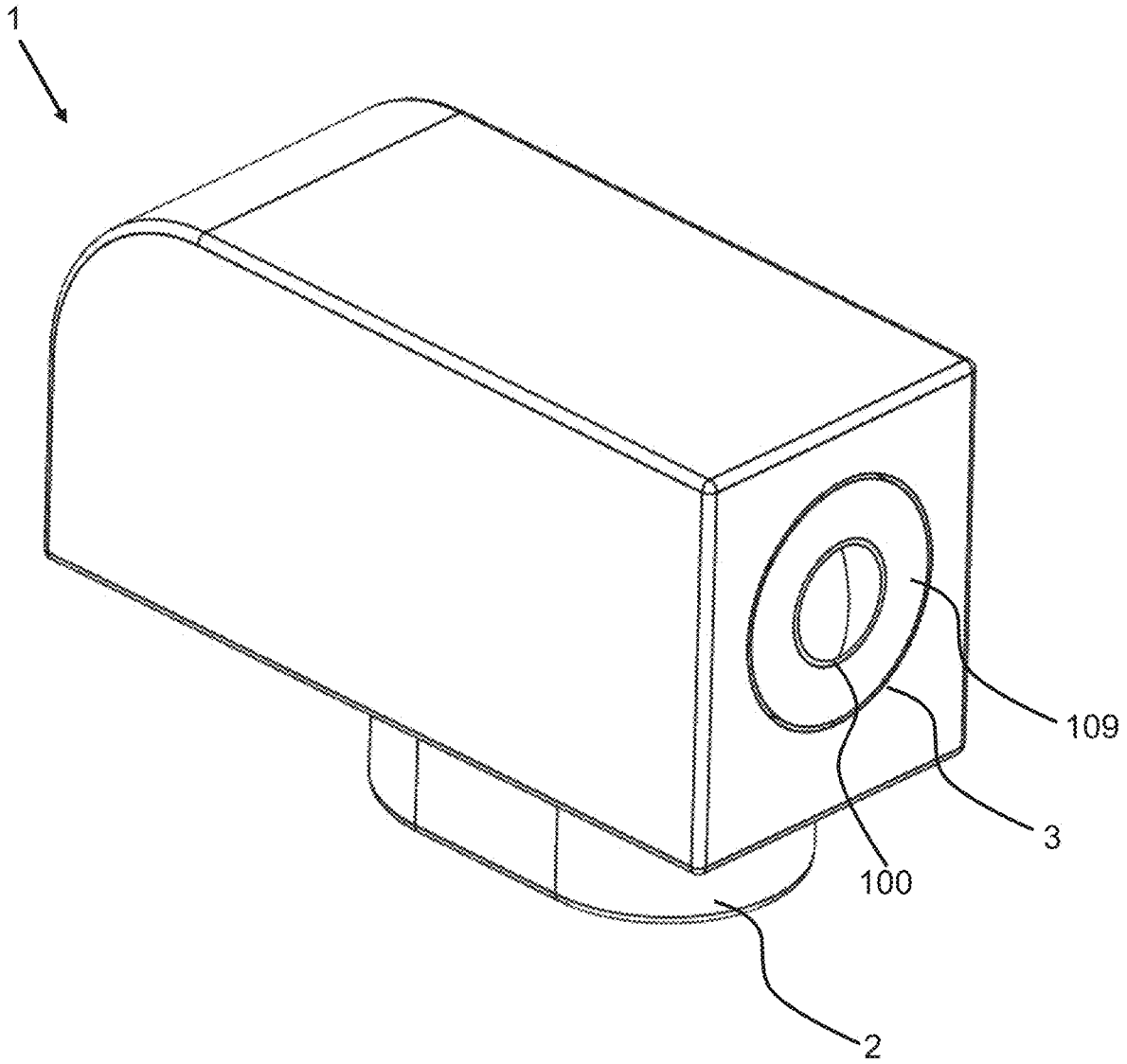
FIG. 1 is a perspective view of a gun sight according to an embodiment.

As shown in FIG. 1, an embodiment of a gun sight 1 is a blade-shaped protrusion with an interface 2 extending from a bottom of gun sight 1. Interface 2 is shaped to be received in a corresponding opening in the firearm to secure gun sight 1 to the firearm. Any suitable technique for securing interface 2 (and gun sight 1) into the firearm can be used, such as an interference fit or the use of mechanical fasteners. One such technique is to form interface 2 into a dovetail shape, with a corresponding groove on the body of the firearm to receive interface 2. The dovetail is retained in the groove on the firearm either by friction (e.g., via a press fit), or through a mechanical fastener such a setscrew passing through interface 2 into the firearm. However, other shapes of and attachment techniques for interface 2 can be used without departing from the present disclosure.

Also visible in FIG. 1 is an insert 100 mounted into gun sight 1. Insert 100 is visible from an exterior of gun sight 1. As shown in FIG. 1, insert 100 can be mounted flush with one surface of gun sight 1, which is the surface that faces the user when gun sight 1 is mounted on the firearm. In this way insert 100 can provide a visual contrast with the remainder of gun sight by being, for example, a different color than the remainder of gun sight 1. This visual contrast helps the firearm user visually acquire the sight. In the type of gun sight 1 shown in FIG. 1, a single insert 100 is present. However, other types of gun sights 1 may include more than one insert 100, for example two inserts 100.

Insert 100 is securely mounted into gun sight 1 such that insert 100 will not separate from gun sight 1 during firearm operation. This means that insert 100 can be mounted to resist physical shocks discharged by use of the firearm. Insert 100 can also remain secured in gun sight 1 when exposed to environmental factors such as large temperature differences, which can be substantial in some scenarios where gun sight 1 and insert 100 are exposed to heat created by the discharge of the firearm.

Insert 100 is formed from an insert body 104. Insert body 104 can be any suitable shape and dimensions that is compatible with gun sight 1. For example, in some embodiments insert body 104 is approximately cylindrical in shape. Insert body 104 can be constructed from any suitable material, including plastic, metal, and composite materials. Notably, the materials of insert body 104 should be both shock and temperature resistant to ensure suitable performance of insert 100.

Also present on some embodiments of insert 100 is a day ring 109 (see FIGS. 1-4). Day ring 109 is positioned at a proximal end 102 of insert 100 and functions to improve visual acquisition of insert 100. To accomplish this, day ring 109 is positioned such that it is visible from an exterior of gun sight 1 when insert 100 is inserted in gun sight 1. In some embodiments, day ring 109 can be a different color than gun sight 1 and/or insert 100 to improve visual acquisition. Day ring 109 can be an integral part of insert 100, or can be a separate element that is fixed to insert 100 by any suitable method, such as the use of adhesives or welding.

Figure 2:
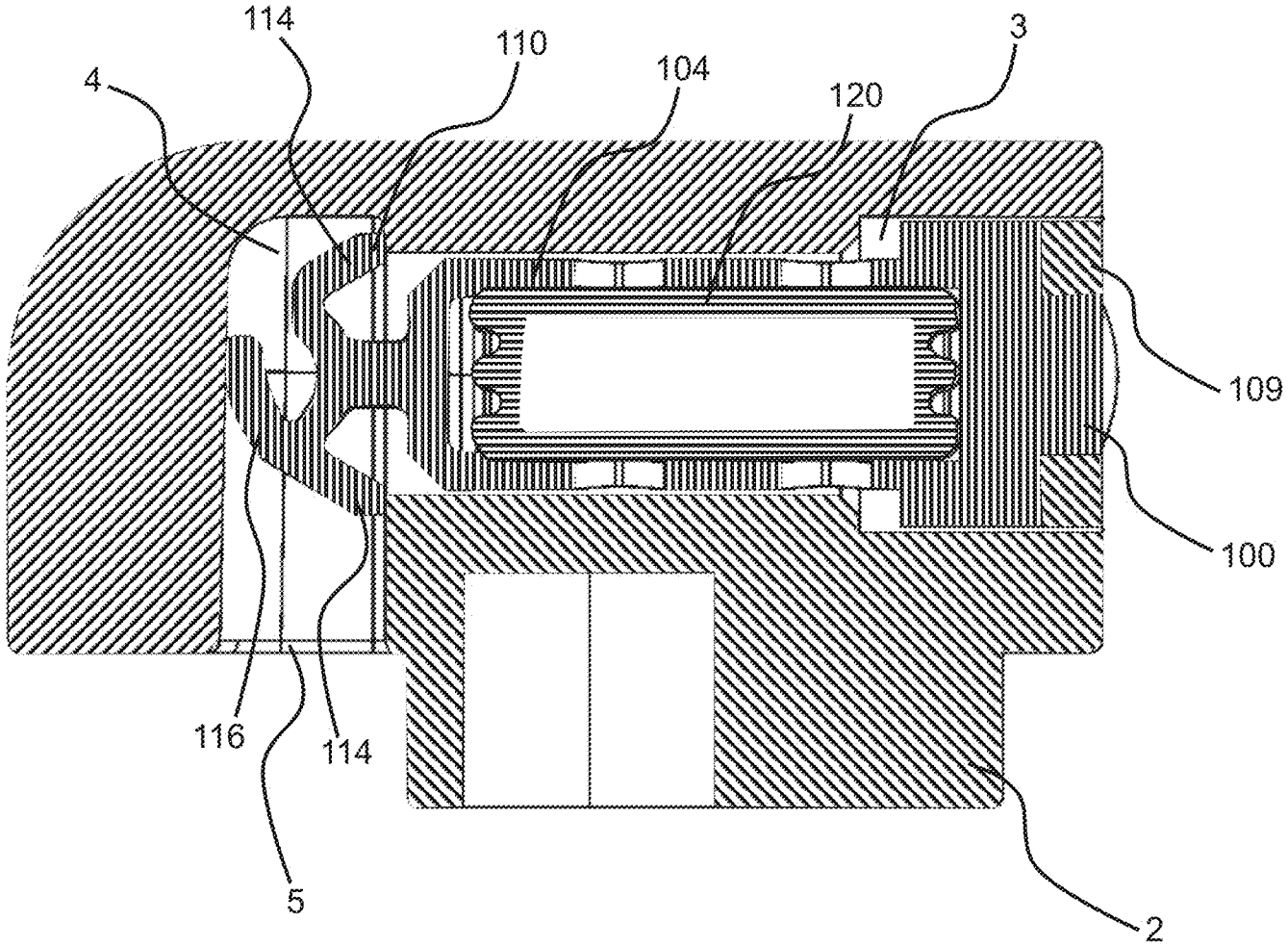
FIG. 2 is an exploded view of a gun sight according to an embodiment.
Figure 3:
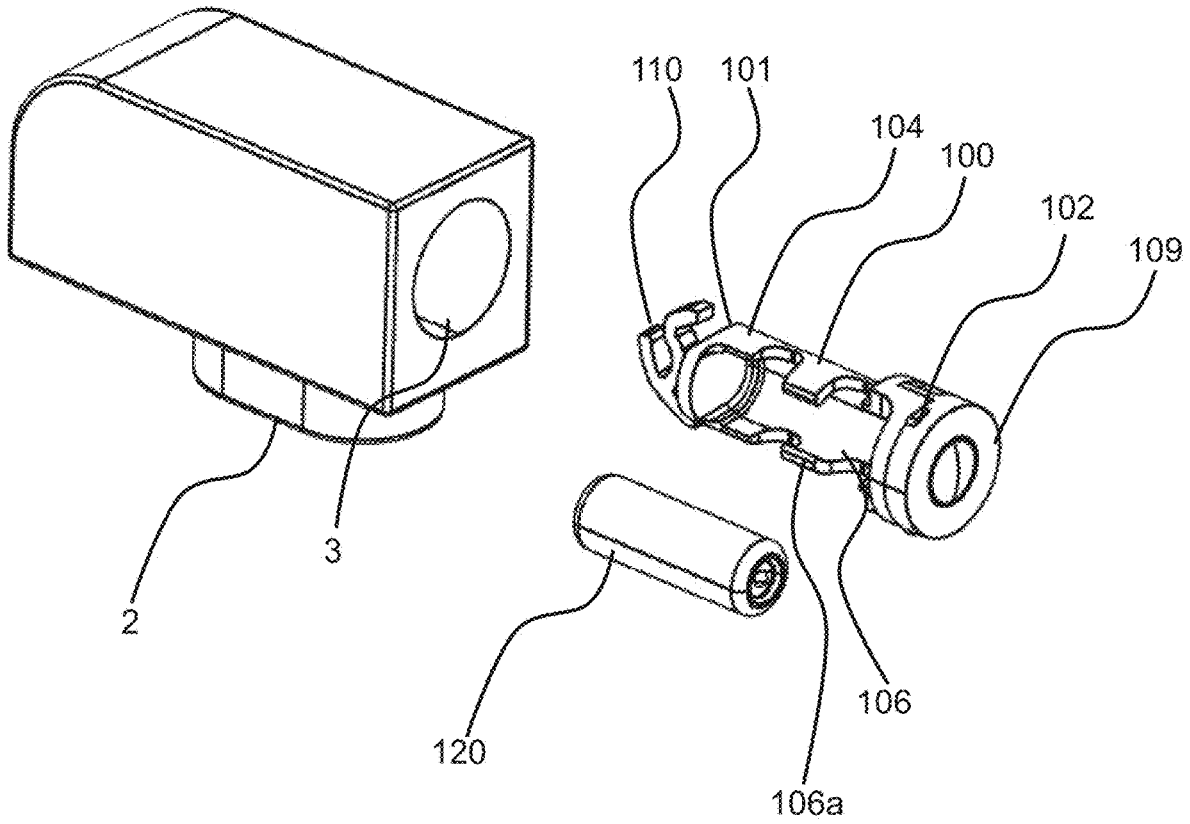
FIG. 3 is a cross section view of a gun sight according to an embodiment.

Insert 100 is secured in gun sight 1 by the interaction between a locking feature 110 disposed on insert body 104 of insert 100 and an interior of an opening 3 in gun sight 1. Locking feature 110 can extend from any suitable surface of insert body 104. For example, in some embodiments, locking feature 110 may extend radially outwards from insert body 104. In other embodiments, locking feature is disposed at a distal end 101 of insert body 104. As can be seen in FIGS. 2-3, opening 3 is accessible from the exterior of gun sight 1 and is configured to receive insert 100. Once insert 100 is placed into opening 3, locking feature 110 contacts at least one portion of the interior of gun sight 1 to prevent insert 100 from being removed through the open end of opening 3. In some embodiments, the mechanical interaction between insert 100 and gun sight 1 are the only technique used to secure insert 100 in opening 3. In these embodiments, there are no additional securing elements, such as adhesives or mechanical fasteners, present. In other embodiments, elements like adhesives can be used to supplement retention of insert 100, along with locking feature 110.

Figure 4:
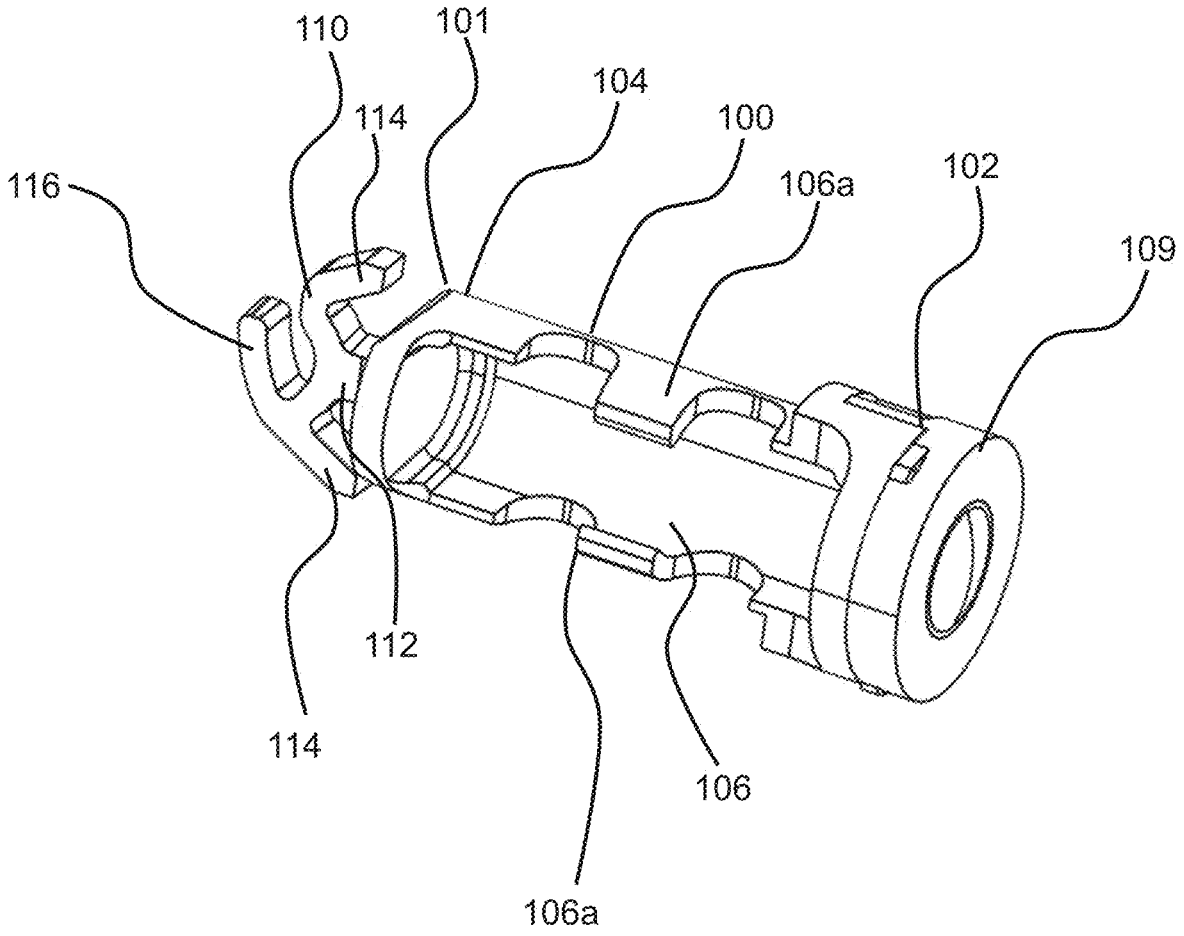
FIG. 4 is a perspective view of an insert for a gun sight according to an embodiment.

In some embodiments, as seen in FIGS. 2-4, locking feature 110 is fixed to distal end 101 of insert 100. Distal end 101 is the end of insert 100 that is inserted into gun sight 1 first, and is thus at the opposite end of insert 100 than proximal end 102, which is the end closest to the user once insert 100 is mounted into gun sight 1. For purposes of this disclose, the direction extending between proximal end 102 and distal end 101 will be termed the longitudinal direction for ease of reference.

Locking feature 110 includes a stem 112 that is the portion of locking feature 110 that is fixed to distal end 101. Stem 112 is rigidly fixed to insert 100 such that there is no relative motion between stem 112 and insert 100. In some embodiments, stem 112 is an integral part of insert 100 such that stem 112 is a continuous extension of insert 100. In other embodiments, stem 112 can be fixed to insert 100 by any suitable method such as by the use of adhesives or welding.

As seen in FIGS. 2 and 4, stem 112 extends in the longitudinal direction away from insert 100 (away from distal end 101). Fixed to stem 112 are at least one locking portion 114. FIGS. 2 and 4 show locking feature 110 having two locking portions 114, each being fixed to stem 112. There may be more or less locking portions 114 present. For example, there may be one, two, three, or four locking portions 114 fixed to stem 112. In some embodiments, locking portion 114 is an integral part of stem 112 such that locking portion 114 is a continuous extension of stem 112. In other embodiments, locking portion 114 can be fixed to stem 112 by any suitable method such as by the use of adhesives or welding.

Locking portions 114 function to contact part of the interior of a locking recess 4 of gun sight 1 to secure insert 100 in opening 3, as seen for example in FIG. 3. In the embodiment of FIGS. 2-4, locking portions 114 are fixed at the end of stem 112 opposite distal end 101. Locking portions 114 are placed symmetrically about stem 112, which mean that in the case of two locking portions 114, as shown, locking portions 114 are separated by 180 degrees with respect to rotation about the longitudinal direction. A symmetrical distribution of locking portions 114 can be achieved with any number of locking portions 114 greater than one. This distribution can have the benefit of distributing the retention of insertion 100 evenly with respect to rotation about the longitudinal direction.

As discussed above and will be explained in detail below, distal end 101 is the portion of insert 100 inserted into opening 3 first. Thus, locking feature 110 is also inserted into opening 3 and configured to travel through opening 3 to locking recess 4 connected to opening 3. Locking feature 110 can therefore be configured to pass through opening 3. In the embodiments of FIGS. 2-4, each of the two locking portions 114 is shaped similarly and first extends longitudinally away from stem 112 (and insert 100) while extending in a direction perpendicular to the longitudinal direction. Locking portions 114 then change direction and curve back towards insert 100. The resulting shape of locking feature 110 is an "M" shape, with stem 112 forming the center vertical portion of the "M," and locking portions 114 forming the outer vertical segments of the "M" shape. This configuration allows locking feature to pass through opening 3 during assembly because the shape of locking portions 114 allows them to flex inwards towards insert 100 to accommodate movement through opening 3.

Once insert 100 is fully inserted into opening 3, locking feature 110 has passed through opening 3 and is located in locking recess 4. Locking recess 4 is an opening in gun sight 1 that is connected to opening 3. In some embodiments, locking recess 4 has a larger cross-sectional area or diameter than opening 3. When locking feature 110 reaches locking recess 4, the larger area or diameter allows locking portions 114 to flex back to their original positions after having flexed inwards to pass through opening 3. To accommodate this, locking portions 114 are designed to deform elastically during insertion of insert 100, which is to say locking portions 114 flex inwards without any permanent or lasting deformation. Locking portions 114 then return elastically to their original position in locking recess 4, which has the effect of securing insert 100 in opening 3 with respect to the direction that is the opposite of the longitudinal direction. This occurs because of the shape of locking portions 114, which biases locking portions 114 against flexing inwards to accommodate opening 3. As seen in FIG. 3, locking portions 114 contact portions of the interior of locking recess 4 to secure insert 100. It should be understood that opening 3 is generally shaped/configured to have a sliding fit with the outer surface of insert 100, which prevents insert 100 from moving substantially in directions perpendicular to the longitudinal direction (e.g., the longitudinal direction is generally parallel to a length of the firearm barrel).

Also shown in FIGS. 2-4 a clearance portion 116 forms a part of locking feature 110. In some embodiments, as shown in FIGS. 2-4, there may be one clearance portion 116. There may also be more clearance portions 116 present. For example, there may be one, two, three, or four clearance portions 116. In embodiments like the one shown in FIGS. 2-4, clearance portion 116 is fixed to and extends from one of the locking portions 114. In some embodiments, clearance portion 116 is an integral portion of locking portions 114 such that clearance portion 116 is a continuous extension of locking portion 114. In other embodiments, clearance portion 116 can be fixed to locking portion 114 by any suitable method such as by the use of adhesives, welding, or a mechanical interaction such as a press fit.

Clearance portion 116 functions to constrain insert 100 in the longitudinal direction, therefore constraining the insertion depth of insert 100 in gun sight 1. Clearance portion 116 does so by contacting a surface of locking recess 4 that, in these and other embodiments, is different from the surfaces contacted by locking portions 114. As seen in FIG. 4, clearance portion 116 extends longitudinally away from insert 100 and curves inwards in the direction perpendicular to the longitudinal direction (towards a centerline of insert 100, not illustrated). This shape has the function of allowing clearance portion 116 to flex towards and away from insert 100 along the longitudinal direction. This flexing, which is based on elastic deformation of clearance portion 116 in the same manner as discussed above for locking portion 114, has the benefit of functioning like a spring that pushes against the relevant surface of locking recess 4. This spring force (which pushes insert 100 out of opening 3) can be balanced against the force caused by locking portions 114 contacting locking recess 4 to fully secure insert 100 in opening 3. In some embodiments, the interaction between clearance portion 116 and locking portion 114 is the only feature that secures insert 100 in the longitudinal direction. In other words, insert 100 does not contact any other surface that contains insert 100 in the longitudinal direction. Opening 3 can be configured to have varying diameter or cross-sectional area to ensure this is the case, as is shown in FIG. 3 with respect to the larger diameter area of opening 3 that accommodates the larger diameter portion of insert 100. In other embodiments, other elements of insert 100 can function to control insertion depth by contact with portions of opening 3, either in place of or in addition to clearance portion 116. For example, the rear surface of day ring 109 may contact a portion of opening 3 to control insertion depth. Dedicated protrusion may also extend from insert 100 to provide a similar function.

Figure 5:
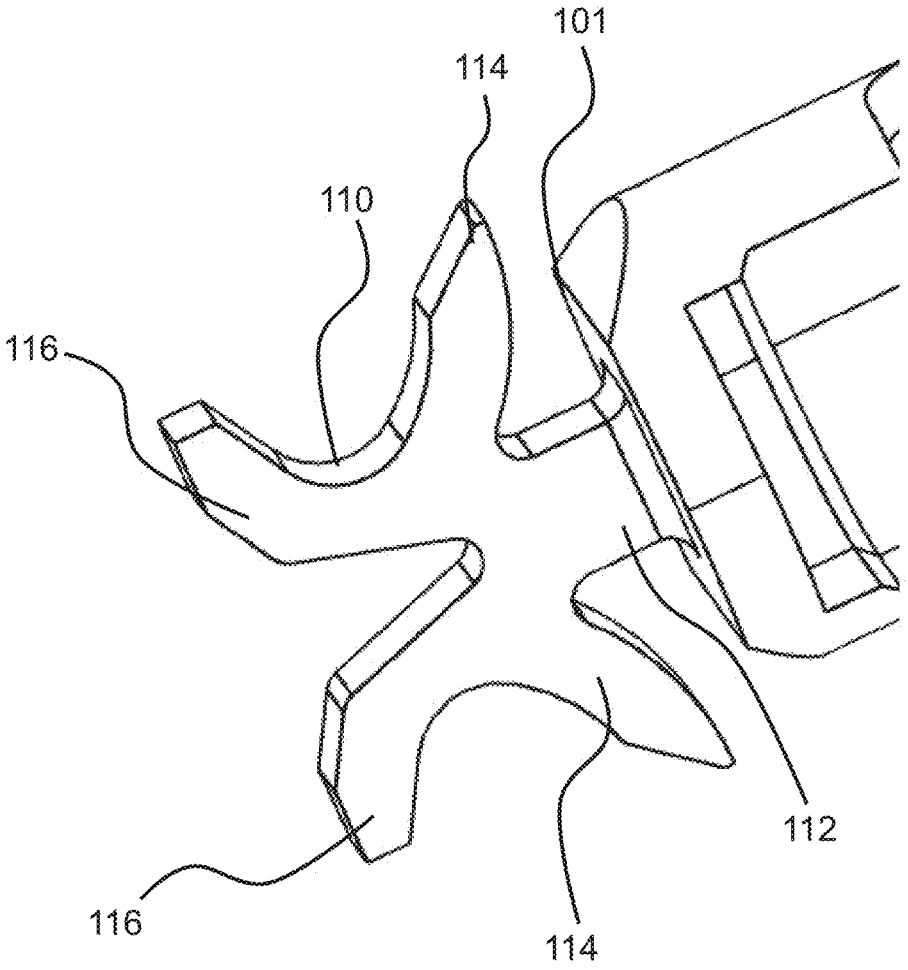
FIG. 5 is a perspective view of a portion of an insert for a gun sight according to an embodiment.

As discussed above, there may be more than one clearance portion 116. FIG. 5 shows an embodiment of locking feature 110 with two clearance portions 116 and two locking portions 114. Here, locking portions 114 extend from stem 112 in the same manner as discussed above with respect to FIGS. 2 and 4. Each clearance portion 116 extends from one of the two locking portions 114 away from insert 100 in the longitudinal direction as well as outwards, away from the centerline of insert 100. Clearance portions 116 and locking portions 114 function in the same manner as discussed above with respect to the contact with the interior of locking recess 4.

Figure 6A:
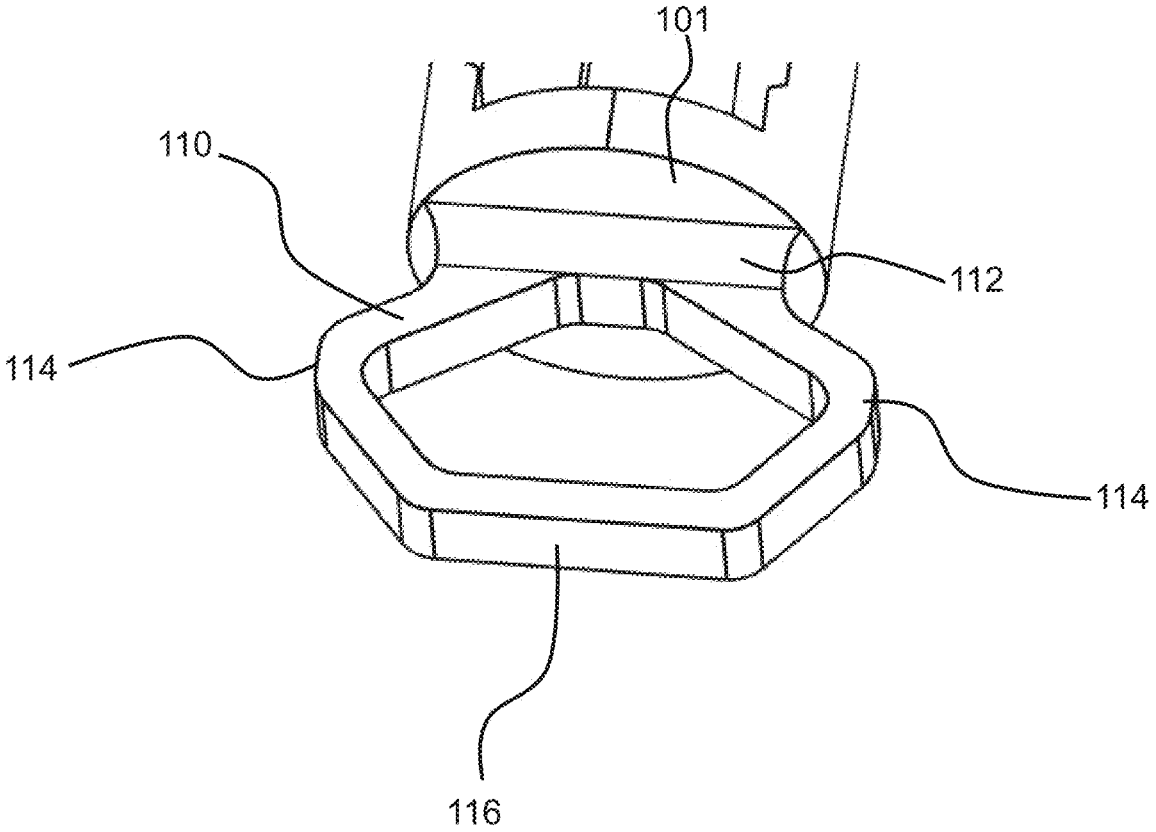
FIG. 6A is a perspective view of a portion of an insert for a gun sight according to an embodiment.
Figure 6B:
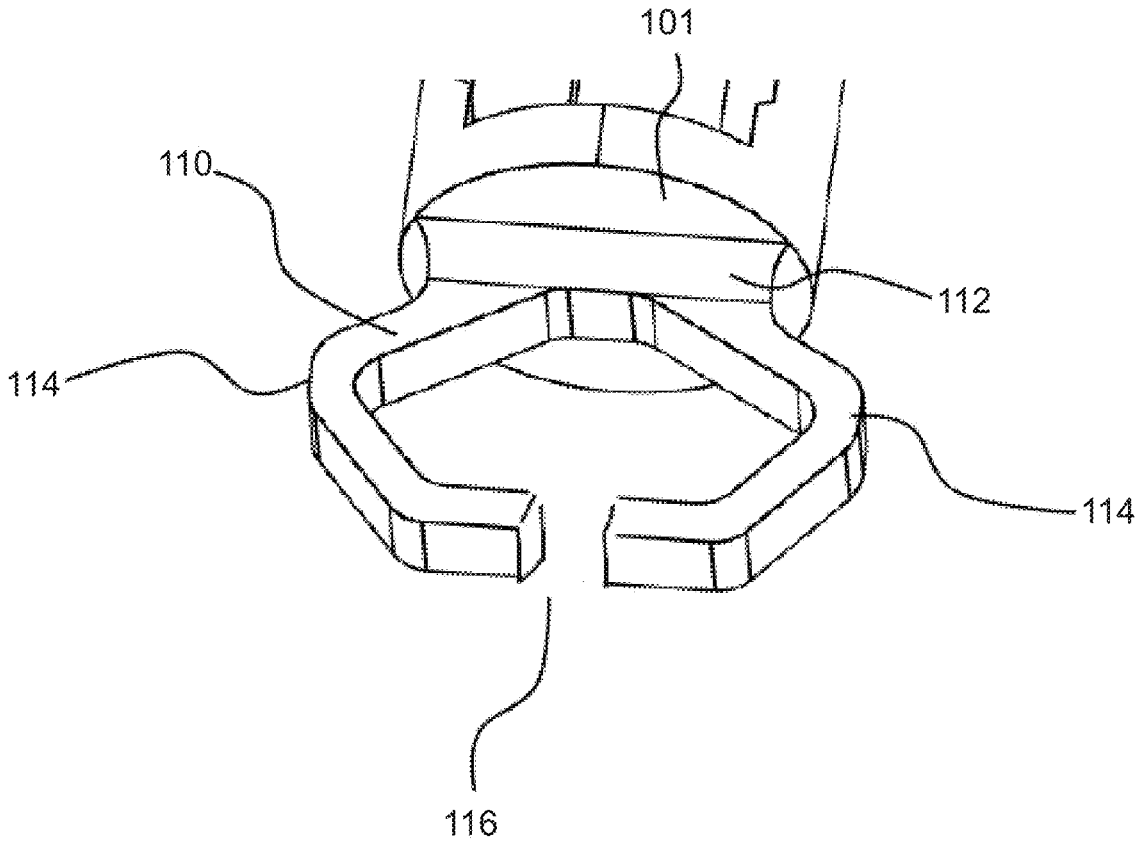
FIG. 6B is a perspective view of a portion of an insert for a gun sight according to an embodiment.

FIG. 6A shows an example of a locking feature 110 that is formed in as a continuous loop structure. As shown, the loop extends from stem 112 in the longitudinal direction, and can be segmented into sections that correspond to locking portions 114 and clearance portion 116. The loop structure is elastically deformable in the same manner as discussed above. The various segments of this embodiment of locking portion 114 contact the interior of locking recess 4 and function in the same manner as discussed above to secure insert 100. FIG. 6B shows an example locking feature 110 that is a variant of the continuous loop structure with a gap or opening interrupting the loop. This locking feature 110 otherwise functions the same as the locking feature 110 in FIG. 6A.

Figure 7:
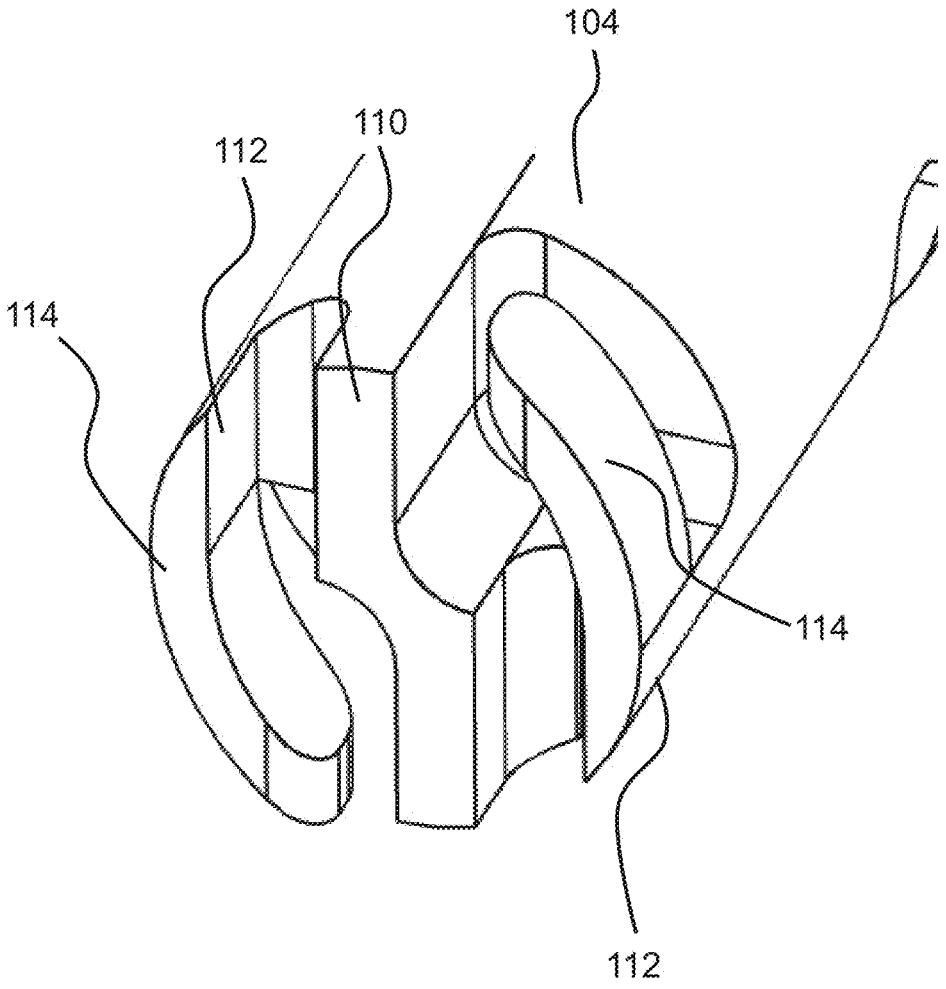
FIG. 7 is a perspective view of a portion of an insert for a gun sight according to an embodiment.

FIG. 7 shows an example of a locking feature 110 that includes two locking portions 114. Each locking portion 114 extends from a dedicated stem 112, and is shaped such that locking portion 114 travels in a path that approximates the curved outer surface of insert body 104. However, each locking portion 114 extends radially outwards beyond the outer surface of insert body 104. Thus, locking portions 114 are able to interface with the interior of locking recess 4 in the same manner as discussed above. In this embodiment, there is no clearance portion 116 present. However, embodiments similar to the embodiment of FIG. 7 can include a clearance portion 116 with similar functionality as discussed above.

Figure 8:
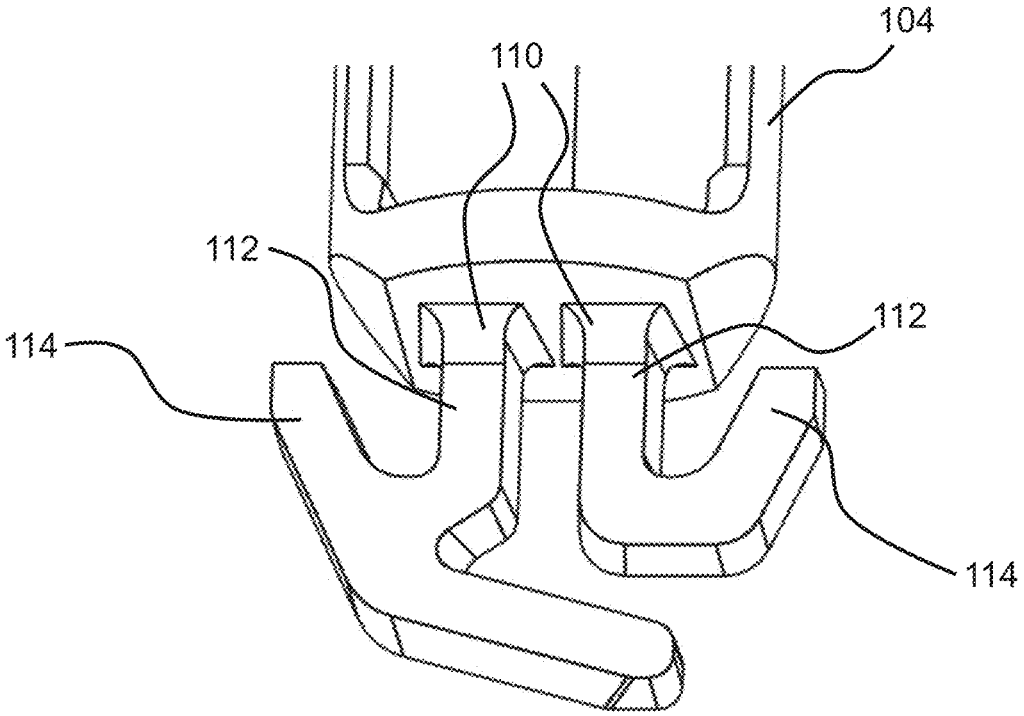
FIG. 8 is a perspective view of a portion of an insert for a gun sight according to an embodiment.

FIG. 8 shows an example of a locking feature 110 that includes two separate stems 112 extending away from insert body 104 in the longitudinal direction. Each stem has a locking portion 114 that is shaped similar to locking portions 114 discussed above with respect to FIGS. 4 and 5. Here, because there are two stems 112, locking portions 114 are not directly connected with each other via stem 112. A clearance portion 116 is provided extending from one locking portion 114 in a manner similar to clearance portion 116 discussed above in FIG. 4.

Insert 100 functions to provide visual contrast with gun sight 1 to improve visual targeting acquisition. In some embodiments, this is accomplished by an illuminator 120 that is received by insert 100. In some embodiments, illuminator 120 is a separate structural element that emits light without requiring a separate power source. In other words, illuminator 120 glows based on its structural and/or material properties. Illuminator 120 can be formed from any self-illuminating structure or material. For example, in some embodiments illuminator 120 is formed as a gaseous tritium light source. This means that illuminator 120 is formed as an at least partially transparent container (e.g., a glass container) that contains gaseous tritium that is configured to self-illuminate or glow. This illumination passes through the container of illuminator 120 and is thus visible from the exterior of illuminator 120. In other embodiments, illuminator 120 can be formed from or coated with other self-illuminating materials, such as photoluminescent or phosphorescent paints. In further embodiments, illuminator 120 may be a self-contained powered light source. For example, illuminator 120 may be a self-contained device having a light source, such as a light emitting diode, and a power source to power the light source, such as a battery.

As seen in FIGS. 2-3, in some embodiments illuminator 120 is received in an illuminator recess 106 formed in insert body 104. Illuminator recess 106 is a cavity shaped to receive and secure illuminator 120 in insert 100. In these embodiments, insert body 104 is shaped to allow illuminator 120 to be seen from an exterior of insert 100 through proximal end 102. For example, there can be a clear portion of insert 100 that allows illuminator 120 to be seen from an exterior of gun sight 1 when insert 100 is placed in gun sight 1.

In some embodiments, illuminator recess 106 can have one or more illuminator retainers **106*a* that are fixed to insert body 104. In the embodiments of FIGS. 2-3, illuminator recess 106 is formed as a partially open cylindrical recess that allows illuminator 120 to be inserted in a radial direction with respect to the cylindrical shape. That is to say, illuminator 120 is inserted in a direction perpendicular to the axis of cylindrical illuminator recess 106. Illuminator retainer 106*a* is formed as a pair of protrusions that follow the wall of the cylindrical illuminator recess 106 and that are configured to have a snap fit interaction with illuminator 120. When inserted, illuminator 120 pushes illuminator retainer 106*a* apart, which results in illuminator retainer 106*a* pressing illuminator 120 into illuminator recess 106. Illuminator 120 is constrained from moving axially by walls formed at either end of illuminator recess 106. In this way, illuminator 120 is securely fixed in insert 100, where it is protected from physical damage from exterior sources once insert 100 is inserted into gun sight 1**.

In other embodiments, illuminator retainer **106*a* can be similar snap fit features that are placed inside illuminator recess 106 at the axial ends of illuminator recess 106 such that axial force on illuminator 120 provides retention in illuminator recess 106. In any of these embodiments, no additional adhesive or other material is present to ensure retention of illuminator 120**.

Figure 9:
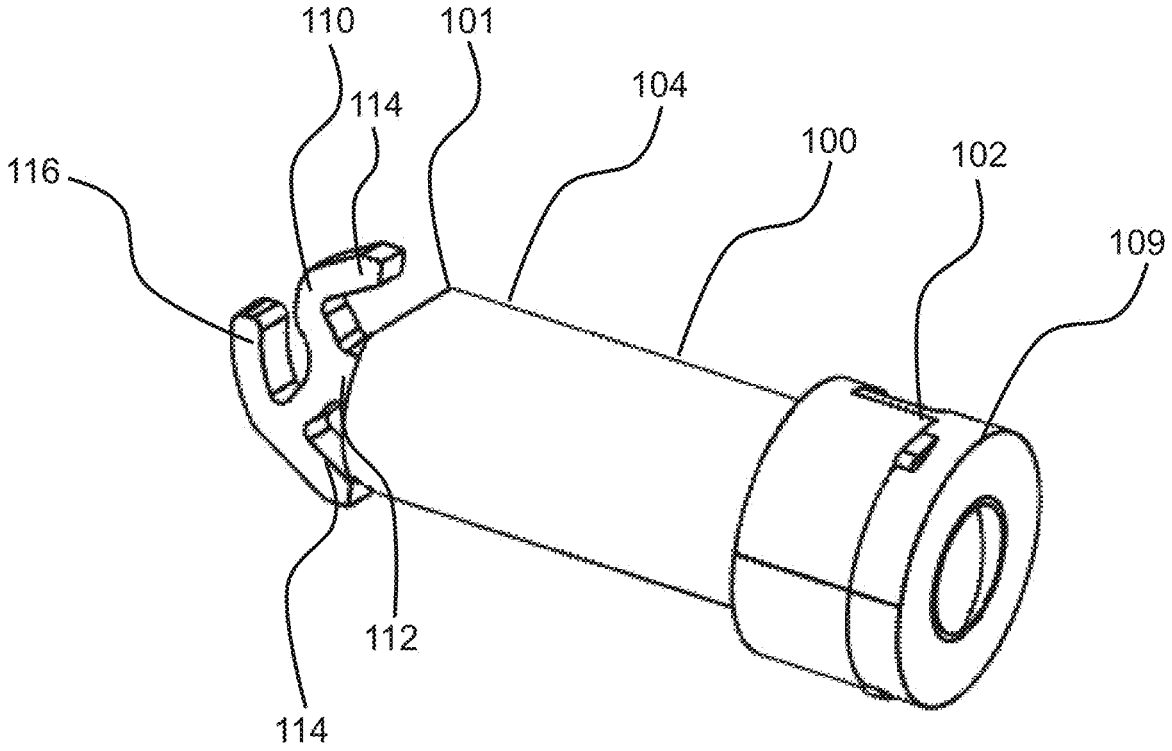
FIG. 9 is a perspective view of an insert for a gun sight according to an embodiment.

In some embodiments, insert 100 does not include a separate illuminator 120. In these embodiments, as shown in FIG. 9, insert body 104 is made from or coated with a self-illuminating material. For example, insert body 104 can be made from a plastic or composite material that incorporates photoluminescent or phosphorescent particles or pigments. Insert body 104 can also be coated with self-illuminating coatings, such as photoluminescent or phosphorescent paint. These embodiments are secured by locking feature 110 in the same manner as discussed above, and therefore differ only in the source of illumination.

As discussed above, some embodiments of insert 100 include an illuminator 120. In some embodiments, illuminator 120 can include materials such as gaseous tritium that requires special handling with respect to access and disposal. Specifically, in the case of gaseous tritium, insert 100 should be configured such that illuminator 120 is not removable by an end user without the use of destructive techniques. The design of insert 100 is such that illuminator 120 cannot be accessed without removing insert 100 from gun sight 1, and thus this means insert 100 should be designed to be permanently installed absent destructive removal techniques.

As discussed above, once locking feature 110 enters locking recess 4, it secures insert 100 into opening 3. Opening 3 is sized to prevent any tools or access to locking feature 110, and thus there is no means for an end user to remove insert 100 after installation. To facilitate the destructive removal of insert 100, locking recess 4 is connected to the exterior of gun sight 1 with a separate access opening 5. As seen in FIG. 3, access opening 5 connects locking recess 4 to an exterior portion of gun sight 1 that is not normally accessible when gun sight 1 is mounted to a firearm. For example, access opening 5 connects to the bottom of interface 2, which is normally covered by the corresponding groove in the firearm.

Removal of insert 100 can be accomplished by first removing gun sight 1 from the firearm to expose access opening 5. Then, a tool can be insert into locking recess 4 and used to sever locking feature 110 from insert 100. Locking feature 110 is designed to facilitate this functionality by being designed to be susceptible to such destructive severing. For example, stem 112 can be made thin enough or weak enough to be severable, while still having sufficient structural integrity to act to secure insert 100 in gun sight 1. This enables the destructive removability of insert 100, which allows for recycling of illuminator 120 after insert 100 is removed. This is especially relevant for embodiments of illuminator 120 with material like gaseous tritium that require specific recycling and disposal techniques.

In an embodiment, a method of assembling insert 100 in gun sight 1 begins by inserting distal end 101 of insert 100 into opening 3 of gun sight 1. Once insert 100 is fully inserted into opening 3, locking feature 110 interacts with locking recess 4 to secure insert 100 in opening 3. In some embodiments, one or more locking portions 114 flex outwards in locking recess 4 to secure insert 100 into opening 3. One or more clearance portions 116 contact separate portions of locking recess 4 to further secure insert 100.

The disclosure above discusses use of insert 100 in a gun sight 1. However, insert 100 can be used in any application that requires an illuminated feature be present, especially in non-powered applications. Examples of suitable applications for insert 100 include non-firearm sights, such as sights for crossbows or bows, illuminating actuating elements, such as a safety lever on a firearm, or illuminating user interface elements, such as the grip on a knife or firearm.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way. Moreover, the examples described above do not limit the present disclosure to what has been particularly shown and described hereinabove. Rather, the scope of the present disclosure includes both combinations and sub-combinations of the various features described hereinabove, as well as variations and modifications thereof which would occur to persons skilled in the art upon reading the foregoing description and which are not disclosed in the prior art.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Various features of the invention which are, for clarity, described in the contexts of separate embodiments may also be provided in combination in a single embodiment. Conversely, various features of the invention which are, for brevity, described in the context of a single embodiment may also be provided separately or in any suitable sub-combination.

The breadth and scope of the present invention should not be limited by any of the above-described exemplary embodiments, but should be defined only in accordance with the following claims and their equivalents.

What is claimed is:

1. An insert for a gun sight having first and second openings, comprising:

an insert body configured to be inserted into the first opening in the gun sight; and a locking feature fixed to an end of the insert body, the locking feature configured to secure the insert body in the gun sight, wherein once inserted, the locking feature is entirely disposed inside the gun sight and is located adjacent to the second opening of the gun sight to facilitate destructive disabling of the locking feature through the second opening.

2. The insert of claim 1, wherein the locking feature is fixed to the end of the insert body that is inserted into the gun sight.

3. The insert of claim 1, wherein a portion of the locking feature is configured to engage a portion of an interior of the gun sight to secure the insert body in the gun sight.

4. The insert of claim 1, wherein a portion of the locking feature is configured to move towards the insert body during insertion of the insert into the gun sight.

5. The insert of claim 1, wherein the locking feature comprises a clearance portion configured to contact a portion of an interior of the gun sight to control an insertion depth of the insert into the gun sight.

6. An insert for a gun sight, comprising:

an insert body configured to be inserted into an opening in the gun sight; and a locking feature fixed to an end of the insert body, the locking feature configured to secure the insert body in the gun sight, wherein the locking feature comprises:

a stem portion fixed to the end of the insert body;

a first locking portion fixed to an end of the stem portion opposite the insert body, the first locking portion extending away from the insert body and configured to engage a portion of an interior of the gun sight to secure the insert body in the gun sight;

a second locking portion fixed to the end of the stem portion opposite the insert body, the second locking portion extending away from the insert body and configured to engage a second portion of the interior of the gun sight to secure the insert body in the gun sight; and a clearance portion fixed to one of the first locking portion or the second locking portion, the clearance portion configured to contact a third portion of the interior of the gun sight to control an insertion depth of the insert into the gun sight.

7. The insert of claim 1, further comprising an illuminator recess located in the insert body and configured to receive an illuminator.

8. The insert of claim 7, wherein the illuminator recess is configured to retain the illuminator in the illuminator recess by contact between at least one illuminator retainer connected to the insert body and the illuminator.

9. The insert of claim 7, wherein the illuminator comprises gaseous tritium to produce illumination.

10. The insert of claim 7, wherein the illuminator comprises a hollow glass body that is coated with a phosphorescent material on an inner side of the hollow glass body.

11. The insert of claim 7, wherein the illuminator comprises a body formed from phosphorescent material.

12. The insert of claim 7, wherein the illuminator comprises a light source and a power source operatively connected to the light source, the light source configured to use the power source to provide illumination.

13. The insert of claim 1, wherein at least a part of the insert body comprises phosphorescent material.

14. An insert for a gun sight, comprising:

an insert body configured to be inserted into an opening in the gun sight;

a locking feature fixed to an end of the insert body, the locking feature configured to secure the insert body in the gun sight; and an illuminator recess located in the insert body and configured to receive an illuminator in a radial direction with respect to the insert body and to retain the illuminator in the illuminator recess by contact between at least one illuminator retainer connected to the insert body and the illuminator.

15. The insert of claim 1, wherein the second opening is located adjacent to the locking feature and is configured to allow a tool to be inserted into the gun sight.

16. The insert of claim 1, wherein the locking feature comprises:

a first stem portion fixed to the end of the insert body;

a first locking portion fixed to an end of the first stem portion opposite the insert body, the first locking portion extending away from the insert body and configured to engage a portion of an interior of the gun sight to secure the insert body in the gun sight;

a second stem portion fixed to the end of the insert body;

a second locking portion fixed to the end of the second stem portion opposite the insert body, the second locking portion extending away from the insert body and configured to engage a second portion of the interior of the gun sight to secure the insert body in the gun sight; and a clearance portion fixed to one of the first locking portion or the second locking portion, the clearance portion configured to contact a third portion of the interior of the gun sight to control an insertion depth of the insert into the gun sight.

17. An insert for a gun sight, comprising:

an insert body formed to be slidingly received into an opening in the gun sight; and a locking feature fixed to an end of the insert body that is inserted into the opening in the gun sight, the locking feature extending from the end of the insert body and having a first locking portion configured to contact a portion of only an interior of the gun sight to secure the insert body in the gun sight, and wherein the locking feature comprises:

a first stem portion fixed to the end of the insert body and extending away from the insert body, wherein the first locking portion is fixed to an end of the first stem portion opposite the insert body and extends from the first stem portion; and a second locking portion fixed to the end of the first stem portion opposite the insert body, the second locking portion extending away from the insert body and configured to engage a second portion of the interior of the gun sight to secure the insert body in the gun sight.

18. The insert of claim 17, wherein the first locking portion extends in a second direction perpendicular to a direction extending between the end of the insert body that is inserted into the opening and a second opposite end of the insert body, the first locking portion formed to elastically deform towards the insert body during insertion of the insert into the gun sight.

19. The insert of claim 17, wherein the locking feature further comprises a clearance portion fixed to one of the first locking portion or the second locking portion, the clearance portion extending away from the insert body and configured to contact a third portion of the interior of the gun sight to control an insertion depth of the insert into the gun sight.

20. The insert of claim 17, further comprising an illuminator recess located in the insert body and configured to receive an illuminator.

21. The insert of claim 20, wherein the illuminator recess is configured to retain the illuminator in the illuminator recess by contact between at least one illuminator retainer of the insert body and the illuminator.

22. The insert of claim 20, wherein the illuminator comprises gaseous tritium to produce illumination.

23. The insert of claim 20, wherein the illuminator comprises a hollow glass body that is coated with a phosphorescent material on an inner side of the hollow glass body.

24. The insert of claim 20, wherein the illuminator comprises a body formed from phosphorescent material.

25. The insert of claim 20, wherein the illuminator comprises a light source and a power source operatively connected to the light source, the light source configured to use the power source to provide illumination.

26. The insert of claim 17, wherein at least a part of the insert body comprises phosphorescent material.

27. The insert of claim 20, wherein the illuminator recess is configured to receive the illuminator in a radial direction with respect to the insert body.

28. The insert of claim 17, wherein the locking feature is configured to be destructively disabled by a tool inserted into the gun sight.

29. The insert of claim 17, wherein the locking feature comprises:

the first stem portion fixed to the end of the insert body, wherein the first locking portion is fixed to an end of the first stem portion opposite the insert body, the first locking portion extending away from the insert body and configured to engage a portion of an interior of the gun sight to secure the insert body in the gun sight;

a second stem portion fixed to the end of the insert body;

a second locking portion fixed to the end of the second stem portion opposite the insert body, the second locking portion extending away from the insert body and configured to engage a second portion of the interior of the gun sight to secure the insert body in the gun sight; and a clearance portion fixed to one of the first locking portion or the second locking portion, the clearance portion configured to contact a third portion of the interior of the gun sight to control an insertion depth of the insert into the gun sight.

30. A method of manufacturing an insert for a gun sight, comprising:

forming an insert body; and forming a locking feature fixed to an end of the insert body and extending away from the end of the insert body, the locking feature configured to be first inserted into the gun sight so as to be entirely disposed inside the gun sight and to secure the insert body in the gun sight without extending through or outside of the gun sight.

31. The method of claim 30, wherein forming the locking feature further comprises:

forming a stem portion fixed to the end of the insert body;

forming a first locking portion fixed to an end of the stem portion opposite the insert body, the first locking portion extending away from the insert body and configured to engage a portion of an interior of the gun sight to secure the insert body in the gun sight;

forming a second locking portion fixed to the end of the stem portion opposite the insert body, the second locking portion extending away from the insert body and configured to engage a second portion of the interior of the gun sight to secure the insert body in the gun sight; and forming a clearance portion fixed to one of the first locking portion or the second locking portion, the clearance portion configured to contact a third portion of the interior of the gun sight to control an insertion depth of the insert into the gun sight.

32. The method of claim 30, further comprising forming an illuminator recess in the insert body that is configured to receive an illuminator, wherein the illuminator recess is configured to retain the illuminator in the illuminator recess by contact between at least one illuminator retainer of the insert body and the illuminator.

33. The method of claim 32, further comprising coating the illuminator with a coating configured to provide illumination in the absence of ambient light.

34. A method of securing and removing an illuminator insert in a gun sight, comprising:

placing the illuminator insert having an insert body with a locking feature disposed at an end of the insert body into an opening in the gun sight, wherein the insert body comprises an illuminator recess to receive an illuminator;

allowing the locking feature to engage with a portion of an interior of the gun sight to secure the insert body into the gun sight; and disabling the locking feature by using a tool inserted through a second opening in the gun sight to enable removal of the illuminator.

* * * * *